US008382616B2

(12) United States Patent
Marshall

(10) Patent No.: US 8,382,616 B2
(45) Date of Patent: Feb. 26, 2013

(54) FLETCHING SYSTEM AND METHOD THEREFOR

(76) Inventor: John Marshall, Destin, FL (US)

( * ) Notice: Subject to any disclaimer, the term of this patent is extended or adjusted under 35 U.S.C. 154(b) by 19 days.

(21) Appl. No.: 12/714,064

(22) Filed: Feb. 26, 2010

(65) Prior Publication Data

US 2010/0151976 A1 Jun. 17, 2010

Related U.S. Application Data

(63) Continuation-in-part of application No. 11/805,590, filed on May 24, 2007, now Pat. No. 7,892,119, which is a continuation-in-part of application No. 11/657,676, filed on Jan. 24, 2007, now Pat. No. 7,758,457.

(51) Int. Cl.
*F42B 6/06* (2006.01)

(52) U.S. Cl. ..... 473/578; 473/586

(58) Field of Classification Search ..... 473/578, 473/585, 586

See application file for complete search history.

(56) References Cited

U.S. PATENT DOCUMENTS

| | | | | |
|---|---|---|---|---|
| 113,835 | A | | 4/1871 | Barton |
| 119,815 | A | | 10/1871 | Brintzinghoffer |
| 509,364 | A | | 11/1893 | Coffeen |
| 1,130,324 | A | | 3/1915 | Owen |
| 1,789,575 | A | | 1/1931 | Allen |
| 1,842,540 | A | | 1/1932 | Cowdery |
| 2,782,036 | A | | 2/1957 | Folberth |
| 3,071,127 | A | | 1/1963 | Spack |
| 4,114,884 | A | | 9/1978 | Tunnicliffe |
| 4,234,192 | A | * | 11/1980 | Salamone ..... 473/586 |
| 4,534,568 | A | | 8/1985 | Tone |
| 4,886,280 | A | | 12/1989 | Bottelsen |
| 5,154,432 | A | * | 10/1992 | Saunders ..... 473/578 |
| 5,427,385 | A | | 6/1995 | Conrad et al. |
| 5,443,273 | A | | 8/1995 | Lovorn |
| 5,987,724 | A | | 11/1999 | Kleman |
| 6,478,700 | B2 | | 11/2002 | Hartman |
| 6,695,727 | B1 | | 2/2004 | Kuhg |
| 7,074,143 | B2 | | 7/2006 | Czemske et al. |
| 2006/0258491 | A1 | | 11/2006 | Walsh |
| 2007/0173359 | A1 | | 7/2007 | Mowery et al. |
| 2008/0176682 | A1 | | 7/2008 | Marshall |
| 2008/0176683 | A1 | | 7/2008 | Marshall |

OTHER PUBLICATIONS

U.S. Appl. No. 12/787,041, filed May 25, 2010, Marshall et al.

* cited by examiner

*Primary Examiner* — John Ricci
(74) *Attorney, Agent, or Firm* — Woodcock Washburn LLP

(57) ABSTRACT

A fletching system and method that allows for quick and easy attachment of a fletching member to an arrow or cross bolt shaft provides a slotted fletch holder adapted to receive a fletching member projecting therethrough and an external end cap member to provide frictional fit engagement with a flanged base portion of the fletching member wherein the flanged base portion is secured between the end cap member and an internal surface of a sidewall of the fletch holder.

20 Claims, 4 Drawing Sheets

FLETCHING SYSTEM AND METHOD THEREFOR

RELATED APPLICATION

The present United States Non-provisional Utility Patent application is a continuation-in-part of, and hereby claims priority to, and the full benefit of, each of the following applications: United States Non-Provisional patent application Ser. No. 11/805,590, filed on May 24, 2007, now U.S. Pat. No. 7,892,119, issued on Feb. 22, 2011, which is a continuation-in-part of United States Non-Provisional Utility patent application Ser. No. 11/657,676, filed on Jan. 24, 2007, now U.S. Pat. No. 7,758,457, issued on Jul. 20, 2010, both of which are entitled "Fletching System and Method Therefor", and both of which are incorporated herein by reference.

TECHNICAL FIELD

The present invention relates generally to archery, and more specifically, to a fletching system and method.

BACKGROUND

Bows and arrows have long been used in many various fields of endeavor, such as combat, hunting, sport, competition, and recreation. In almost all instances, accuracy is critical in achieving a successful shot. Most notably, flight characteristics of the arrow play a large role in determining the accuracy of the shot. In order to adjust the flight characteristics of an arrow, one or more fletching member, also known by the terms, vane or feather, is typically provided on the shaft of an arrow. The design and attachment of the fletching members affect drag, spin, and trueness of flight, in addition to other flight characteristics.

Typically, fletching members are attached to the outside of an arrow shaft using an adhesive. Correct alignment and positioning of the fletching members during attachment is usually attempted by using a fletching jig that retains the fletching members in the proper position while the adhesive cures. Unfortunately, the process of applying the fletching members using conventional jigs is tedious, difficult, time-consuming, and does not ensure accurate results. For example, one or more fletching members may become misaligned, and/or excess adhesive may flow out from between a fletching member and the arrow shaft, making a mess and potentially interfering with the proper function of the fletching members.

In addition, the jig is an expensive piece of specialized equipment and can only be used to apply fletching members to a single arrow shaft at a time. Since the jig must remain attached to the arrow shaft until the adhesive cures, fletching techniques using a conventional jig are limited in their efficiency. Thus, fletching using a conventional jig typically takes a long time and is done well in advance of the time when the arrow is to be fired. This means that arrows are typically transported with the fletching members attached, whereby the fletching members may be damaged or become detached from the arrow shaft, thereby necessitating time-consuming repair.

Finally, conventional fletching techniques cannot practically be performed in the field in the event that a fletching member is damaged during use or transportation, due to inconvenience of carrying the jig, as well as the long curing time associated with the use of adhesive. Thus, archers typically carry more "spare" arrows than they would need if fletching member repair could practically be performed in the field.

It is desirable, therefore, to provide a fletching system, and a method therefor, that ensures proper alignment of the fletching members, is inexpensive, efficient, and easy to use; thereby, reducing the time and cost needed to apply fletching members to an arrow shaft, and that allows fletching members to be attached to an arrow shaft in the field, such as during a repair; further, thereby, reducing the number of "spare" arrows that an archer needs to purchase, prepare, and carry.

SUMMARY

Briefly described, in a preferred embodiment, the present invention overcomes the above-mentioned disadvantages and meets the recognized need for such a system and method therefor by providing an arrow or cross bolt shaft cooperatively affixed to a first end of a fletch holder, the fletch holder having a recessed or hollow portion and at least one slot running longitudinally therealong with respect to a long axis of the fletch holder, the slot being open at a second end of the fletch holder, the fletch holder cooperatively affixed at the second end thereof to a first end of an end cap member, a second end of the end cap member cooperatively affixed to a nock, and a fletching member having a flanged base, whereby the fletching member may be captured and retained in a position projecting through the slot of the fletch holder by affixation of the end cap member to the fletch holder.

According to its major aspects and broadly stated, the present invention in its preferred form is a system comprising an arrow or cross bolt shaft cooperatively affixed to a first end of a fletch holder, preferably via threaded engagement means; the fletch holder having a recessed or hollow portion and at least one slot, and preferably a plurality of slots, running longitudinally therealong with respect to a long axis of the fletch holder; each slot being open at a second end of the fletch holder; the fletch holder cooperatively affixed at the second end thereof, preferably via threaded engagement means, to a first end of an end cap member; a second end of the end cap member cooperatively affixed, preferably via press fit or threaded means, to a nock; and one or more fletching member, each preferably having a flanged base; whereby each fletching member may be captured and retained in a position projecting through a slot of the fletch holder by affixation of the end cap member to the fletch holder.

In assemblage of such an embodiment, the end cap member acts to compress each slot of the fletch holder radially about a respective fletching member; thereby, to capture and securely, but removably, affix each fletching member into a respective slot of the fletch holder. Advantageously, in order to replace a fletching member, a user need only remove the end cap member in order to slideably remove a fletching member. The user then may slidably insert a replacement fletching member, reattach the end cap member, and, thereafter, immediately be ready to rebow the arrow or cross bolt to fire.

According to another embodiment, each slot is formed generally radially through and axially along the sidewall of the hollow portion of the fletch holder.

According to another embodiment, each slot is formed in a spiral configuration.

According to another embodiment, each slot is formed in a helical configuration.

According to another embodiment, the slot has at least a portion having a greater width than the rest of the slot for slidably receiving the flanged base therethrough.

According to another embodiment, the end cap member has a nock integrally formed on an end thereof that projects at least partially from an end of the arrow or cross bolt shaft.

According to another embodiment, a portion of the fletch holder is retained in removable, frictional fit with an interior surface of the arrow or cross bolt shaft.

According to another embodiment, the fletch holder has flange means to limit axial insertion of the flanged base of a respective fletching member.

According to another embodiment, the end cap member is rotatable to increase a retaining force retaining the flanged base of each fletching member against the interior surface of the arrow or cross bolt shaft.

According to another embodiment, conventional fletching members can be used with the system.

The present invention further overcomes the above-mentioned disadvantages and meets the recognized need by providing a method of attaching a fletching member to an arrow or cross bolt shaft comprising the steps of sliding a fletching member into a slot formed in the fletch holder, the flanged base portion of the fletching member preferably residing within a recess or hollow portion of the fletch holder, and removably affixing an end cap member to an end portion of the fletch holder adjacent the slot, such that the end cap member compresses the slot of the fletch holder in order to securely attach the fletching member to the fletch holder.

Accordingly, a feature and advantage of the present invention is its ability to quickly, accurately, easily, and removably attach a fletching member to an arrow or cross bolt shaft.

Another feature and advantage of the present invention is its ability to allow for replacement of a damaged fletching member.

Yet another feature and advantage of the present invention is ability to enable an unskilled fletcher to properly attach a fletching member to an arrow or cross bolt shaft.

Another feature and advantage of the present invention is its ability to protect a portion of the fletching member attached to the arrow or cross bolt shaft from damage during use or transportation.

Another feature and advantage of the present invention is its ability to allow for spiral or helical arrangement of a fletching member.

These and other objects, features, and advantages of the invention will become more apparent to those ordinarily skilled in the art after reading the following Detailed Description and Claims in light of the accompanying drawing Figures.

BRIEF DESCRIPTION OF THE DRAWINGS

Accordingly, the present invention will be understood best through consideration of, and reference to, the following Figures, viewed in conjunction with the Detailed Description of the Preferred Embodiment referring thereto, in which like reference numbers throughout the various Figures designate like structure and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF ILLUSTRATIVE EMBODIMENTS

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

Figure 1:
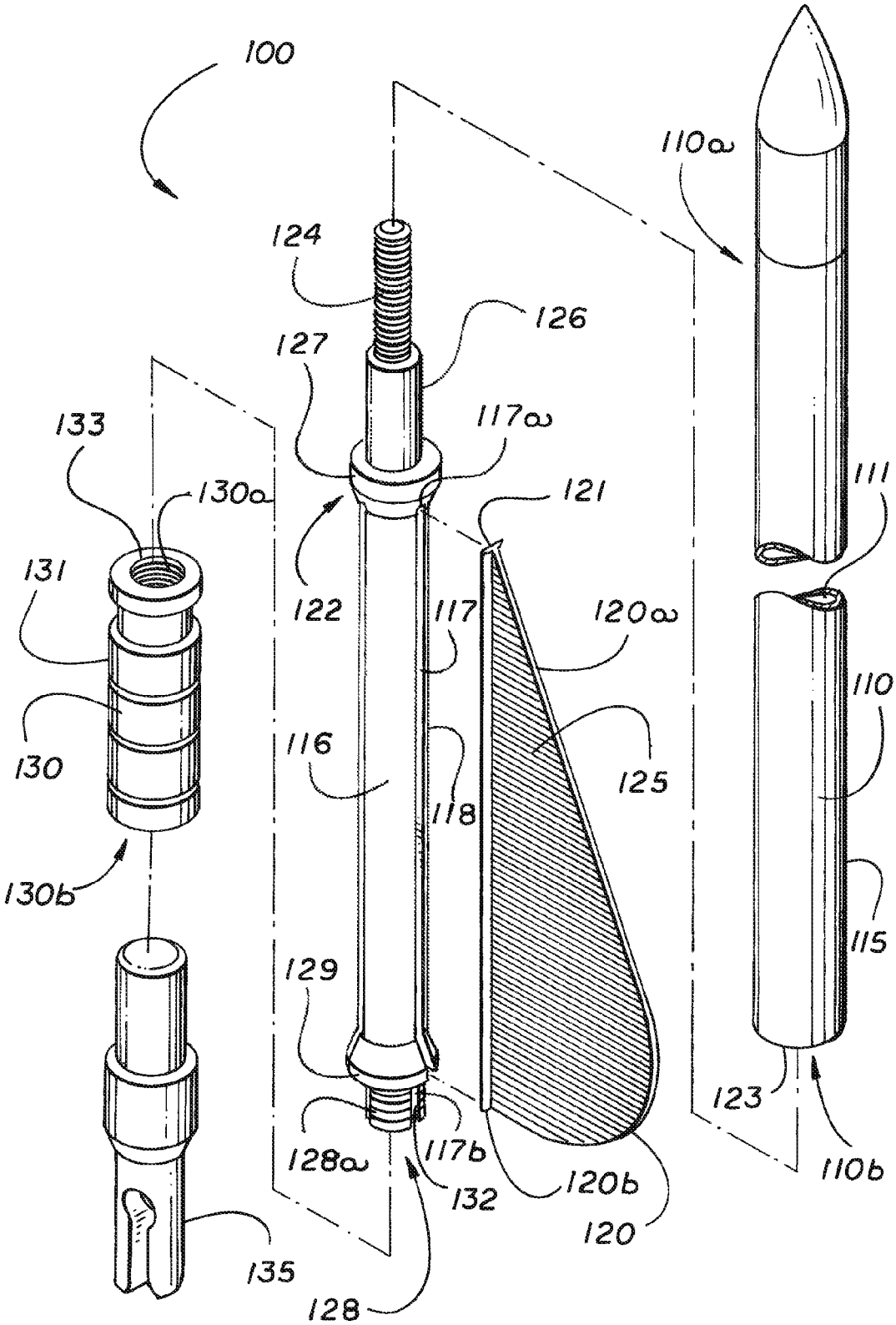
FIG. 1 is an exploded perspective view of the components of the fletching system of the present invention.

In that form of the preferred embodiment of the present invention chosen for purposes of illustration, FIGS. 1-7, generally, show fletching system 100. FIG. 1, specifically, shows an exemplary embodiment of fletching system 100, preferably including arrow shaft 110, at least one fletching member 120, fletch holder 122, and end cap member 130. Arrow shaft 110 preferably comprises an archery arrow shaft generally formed as a hollow circular cylinder. Arrow shaft 110 is preferably formed from aluminum, carbon, or a combination thereof, although arrow shaft 110 may be formed of wood, plastic, graphite, composite, or other suitable material or combinations thereof. It will be understood by those of ordinary skill in the art that arrow shaft 110 may comprise a standard arrow shaft, a slim line arrow shaft, a cross bolt shaft (for use with a cross bow), or the like, without limitation. Accordingly, the term "arrow shaft" as used herein shall be deemed to include conventional arrow shafts and cross bolt shafts, along with all arrow and cross bolt shaft variants. Fletch holder 122 is preferably formed from aluminum, such as 6061-T6511 EXT material, but may also be formed of carbon, wood, plastic, graphite, composite, or other suitable material or combinations thereof.

Arrow shaft 110 preferably comprises hollow center 111 disposed along at least a portion of the length of arrow shaft 110 from first end 110*a* to second end 110*b*, preferably proximate second end 110*b* for receiving fletch holder 122. Hollow center 111 is preferably defined by side wall 115, is preferably open to an outside environment of arrow shaft 110 at first end 110*a*, and preferably extends along the length of arrow shaft 110 toward second end 110*b*. Thus, hollow center 111 preferably allows fletch holder 122 to be inserted into second end 110*b*, preferably via a threaded engagement means.

In the embodiment presented, arrow shaft 110 is fitted with threaded insert 123, of conventional and well-known design, disposed within second end 110*b*. In such configuration, threaded insert 123 becomes a female internal thread. Fletch holder 122 is preferably provided with male threaded end 124. Accordingly, fletch holder 122 may be removably affixed to arrow shaft 110 at second end 110*b* by cooperative, rotational engagement of male threaded end 124 within threaded insert 123.

It is here noted that the threads of threaded insert 123 may be disposed proximate second end 110*b*, or, alternatively, may be inset a defined distance into arrow shaft 110 toward first end 110*a*, according to design selection. In such alternate configuration, fletch holder 122 may be provided with unthreaded, cylindrical portion 126 to allow male threaded end 124 to engage with the inset threads of threaded insert 123, and to, thereby, provide appropriate joint stability and balance characteristics proximate second end 110*b* as is ordinarily to be considered in the arrow art.

In the embodiment shown, fletch holder 122 is provided with flange means 127 serving functional purposes to be described in greater detail hereinbelow. Generally, however, flange means 127 serves as an abutment to arrow shaft 110 proximate second end 110*b*, and as means to limit axial movement of fletching member 120 in the direction of arrow shaft 110.

Figure 3:
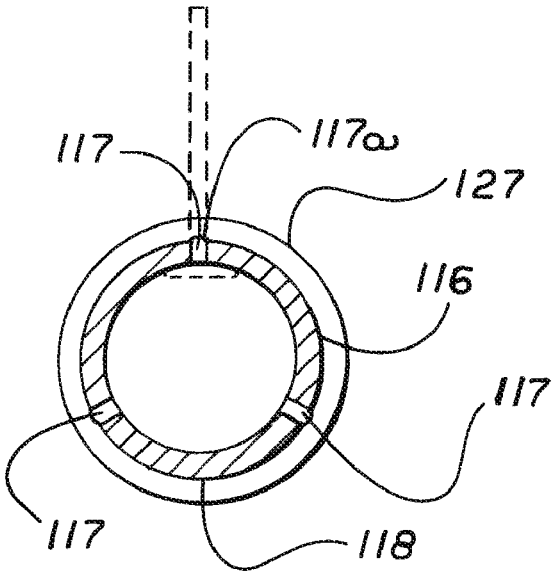
FIG. 3 is a cross-sectional view of the fletch holder of the preferred embodiment.

With reference to FIGS. 1 and 3, fletch holder 122 preferably is formed with a hollow interior extending approximately from flange means 127 through end 128. In another embodiment, however, best seen with reference to FIG. 5, a recess, such as might take the form of a T-shaped slot 117, or the like, may be formed above an axial core portion of fletch holder 122, in order to receive fletching member 120 in the manner more fully described hereinbelow.

In the embodiment shown in FIG. 1, and with continuing reference to FIG. 3, slot 117 is preferably formed radially completely through fletch holder side wall 118 and preferably extends in a straight line generally axially along a portion of the length of fletch holder 122 toward end 128. Slot 117 may, alternatively, be formed in a curved arrangement, such as spiral or helical. Slot 117 preferably defines a closed periphery adjacent flange means 127; however, slot 117 preferably opens to end 128. Thus, slot 117, approximately defined by closed peripheral end 117*a* and open end 117*b*, preferably is closed adjacent flange means 127, but remains open at end 128; thereby, as best seen with reference to FIGS. 6*a*-6*c*, allowing fletching member 120 to be inserted axially from end 128 toward flange means 127, whereby insertion of fletching member 120 is limited and stopped adjacent flange means 127. With addition of end cap member 130 to the aforedescribed assembly, and best seen with reference to FIG. 4, fletching member 120 is completely enclosed within slot 117, and is captured and retained therein, as will be further described hereinbelow.

Figure 7:
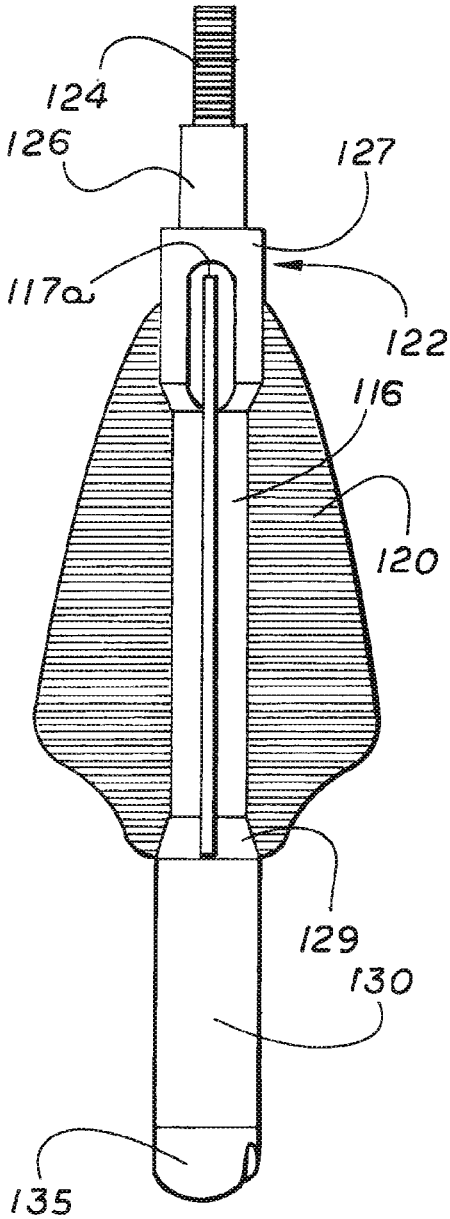
FIG. 7 is a side view of an alternate embodiment of the system as shown in FIG. 1.

It is here to be noted with reference to FIG. 7, that closed peripheral end 117*a* of slot 117 may stop adjacent, near, within, or by flange means 127, according to design criteria. Similarly, closed peripheral end 117*a* of slot 117 may either narrow or widen, again according to design criteria, in order to provide appropriate clearance, or fit, characteristics for first end 120*a* of fletching member 120.

Thus, slot 117 is preferably formed in fletch holder 122 by a machining technique, such as CNC routering, but may alternatively be formed by other manufacturing technique, or may be integrally formed with fletch holder 122 such as during a molding or extrusion process. Slot 117 may, in one embodiment, widen toward, expand, or taper toward, open end 117*b* proximate end 128, for receiving flight control element 125 or flanged base 121 of fletching member 120, as described in more detail hereinbelow.

In the embodiments shown, fletch holder 122 is further provided with flange means 129 serving similar functional purposes considered with regard to flange means 127. That is, flange means 129 serves as an abutment to end cap member 130 proximate end 128, which will be seen as means to limit post-assembly axial movement of fletching member 120 in the direction of end cap member 130, and as an aspect of design consideration for in-flight balance characteristics of fletching system 100. Fletch holder 122 further preferably is formed to include external threads 128*a* at or adjacent end 128. Such external threads might, in some embodiments, be tapered threads.

Figure 2:
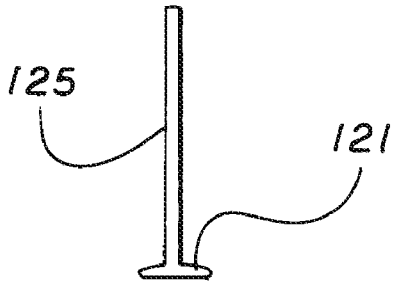
FIG. 2 is a cross-sectional view of the fletching member of a preferred embodiment of the present invention.
Figure 5:
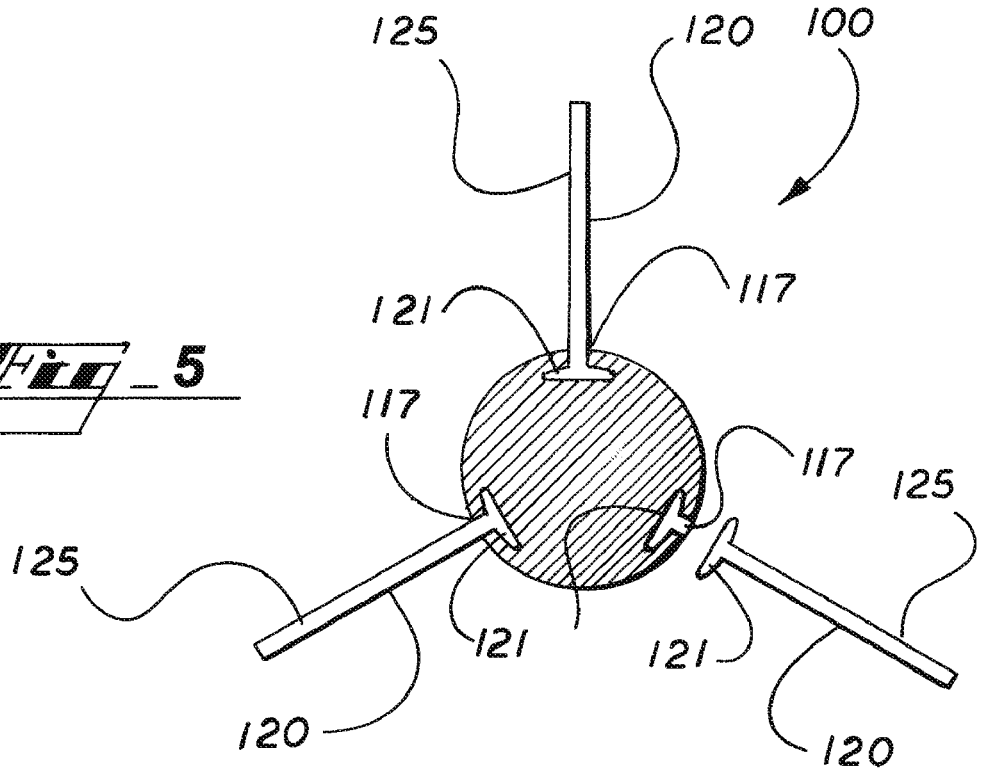
FIG. 5 is a cross-sectional view of an alternate embodiment of the system as shown in FIG. 1.
Figure 4:
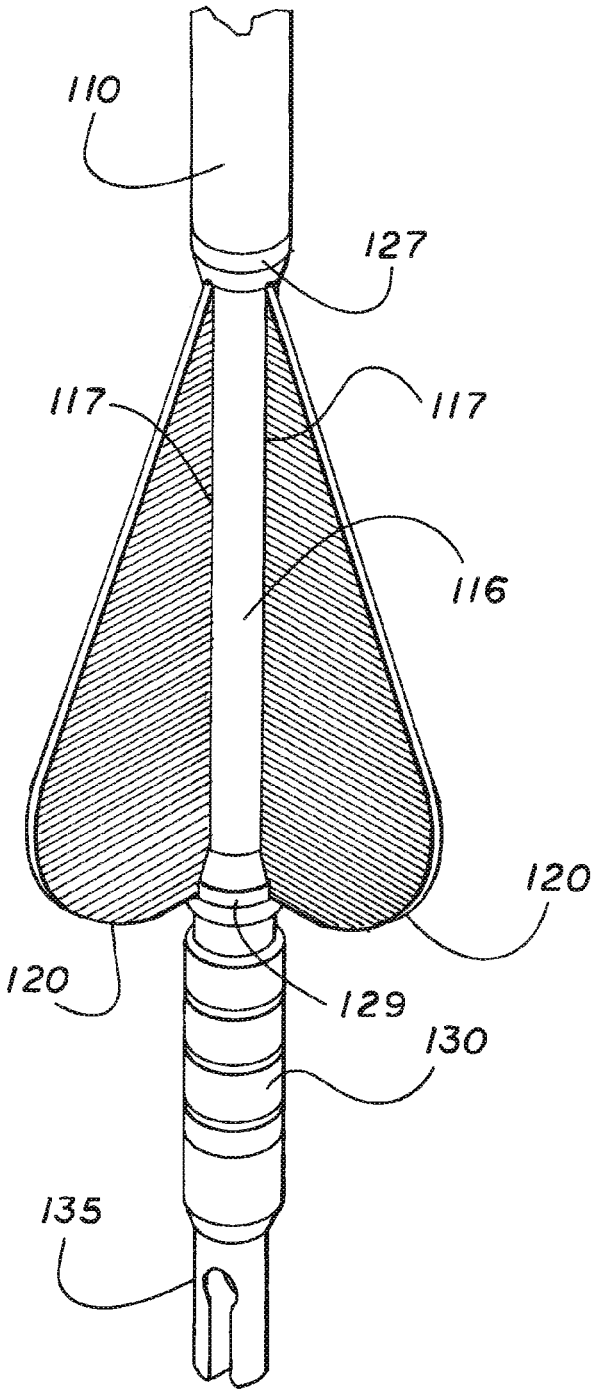
FIG. 4 is a perspective view of the assembled components of the preferred embodiment.

Fletching member 120 preferably comprises a generally T-shaped cross section, as best seen in FIG. 2, comprising flanged base 121 and flight control element 125 generally centered thereon and extending generally perpendicular thereto. Alternatively, however, fletching member 120 may comprise other cross-sectional shapes, so long as the base portion has a width preferably greater than a width of flight control element 125, and preferably greater than a width of at least a portion of slot 117. Flanged base 121 preferably provides a means for attaching flight control element 125 to fletch holder 122 such that flight control element 125 projects generally perpendicular to exterior surface 116 of fletch holder 122 in order to give arrow shaft 110 beneficial flight characteristics. Preferably, such means for attachment comprises the base portion having a width greater than a width of at least a portion of slot 117, such that once the base portion is disposed within the hollow interior portion of fletch holder 122, the base portion may be retained therein by the configuration of slot 117 acting in compressive, operable association with end cap member 130.

Fletching member 120 is preferably formed from plastic such as by a molding or an extrusion process, and flanged base 121 and flight control element 125 are preferably integrally formed. Alternatively, however, fletching member 120 may be formed of any suitable natural or synthetic material which is sufficiently pliable and resilient to allow fletching member 120 to deform upon contact with a foreign object; thereby, avoiding or reducing damage thereto, and allowing fletching member 120 to return to its original shape, or near original shape, when not in contact with such foreign object. Furthermore, flanged base 121 and flight control element 125 may, alternatively, be formed of different materials and may be formed separately and joined using an adhesive or other suitable fastener or joining technique. Preferably, flanged base 121 has a width approximately equal to, or slightly less than, the maximum width of slot 117 at open end 117*b*, and flight control element 125 preferably has a thickness approximately equal to, or slightly less than, the width of slot 117 at closed peripheral end 117*a*. Thus, and as best seen with continuing reference to FIGS. 6*a*-6*c*, when flanged base 121 is inserted into slot 117 at open end 117*b* and into the preferably hollow center portion of fletch holder 122, preferably starting at first end 120*a* and continuing along the length of fletching member 120 to second end 120*b*, flight control element 125 preferably protrudes through slot 117 and is in friction fit with fletch holder side wall 118 due to the tight fit of flight control element 125 within slot 117. When inserted through open end 117*b*, flanged base 121 preferably remains proximate to or in contact with interior surface 132 of fletch holder side wall 118.

End cap member 130 is preferably formed of aluminum, plastic, or other suitable material that is lightweight and sturdy, such as carbon, graphite, titanium, magnesium, composite, or other similarly suitable material. End cap member 130 is preferably formed as a generally elongated circular cylinder and preferably includes generally hollow interior 133 formed axially through end cap member 130. Within interior 133 are provided internal threads 130*a*, such that external threads 128*a* are cooperatively engageable with internal threads 130*a* of end cap member 130. Accordingly, internal threads 130*a* might, in some embodiments, be tapered threads. Internal threads 130*a* may be machined directly into end cap member 130, or may be provided in the form of a threaded insert. In either case it will be apparent that sufficient thread length of internal threads 130*a* must be provided in order to engage external threads 128*a*, and to firmly hold end cap member 130 onto fletch holder 122 for the purposes described herein.

It is further noted that outer surface 131 of end cap member 130 may be knurled, channeled, or otherwise textured, in order to provide an appropriate gripping surface for a user of fletching system 100. Additionally, outer surface 131 of end cap member 130 may be otherwise shaped for conforming surfaces to their corresponding mates at the ends thereof, or to meet user preference, style, or other design criteria.

End cap member 130 preferably includes nock 135 disposed on second end 130*b* thereof. Nock 135 is preferably adapted to engage a bow string of an archery bow for use in shooting arrow shaft 110. For purposes of retaining nock 135, second end 130*b* of end cap member 130 may be configured to frictionally engage a mating portion of nock 135, as by cooperating internally and externally press-fit or tapered surfaces, by cooperating internally and externally threaded portions, by adhesives applied to mating surfaces, by unitary or integrally-formed (single piece) construction, or the like, all as are well-known in the art. Accordingly, in some embodiments, nock 135 may have a diameter approximately equal to end cap member 130 or arrow shaft 110.

Preferably, as best shown in FIG. 3, fletch holder 122 has a number of slots 117 formed therein, with a plurality of fletching members 120 inserted therein, the entire assembly for affixation to arrow shaft 110. Preferably, in accordance with conventional use by archers, three fletching members 120 are inserted within fletch holder 122 through three equally-spaced slots 117.

Figures 6A, 6B, 6C:
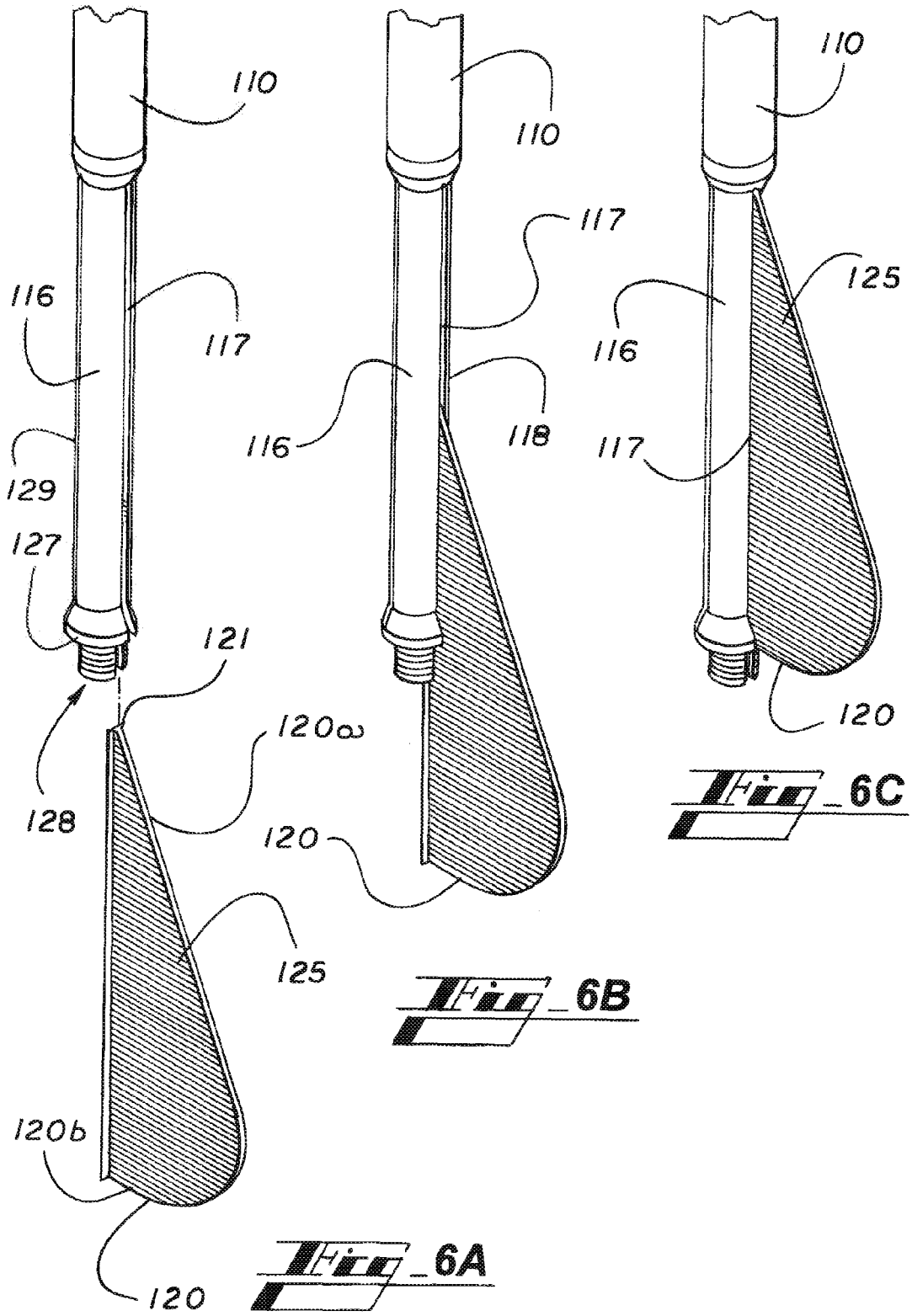
FIGS. 6A-6C are perspective views depicting the insertion of a fletching member into the slot of a fletch holder affixed to an arrow or cross bolt shaft according to a preferred embodiment of the present invention.

In use, and as illustrated in FIGS. 6A-6C, a portion of flanged base 121 of fletching member 120 proximate first end 120*a* is preferably inserted through slot 117 at open end 117*b*. Fletching member 120 is then preferably slid towards closed peripheral end 117*a* of fletch holder 122 such that the rest of flanged base 121 is slid through or under slot 117, again preferably through open end 117*b*. Such sliding insertion of fletching member 120 preferably disposes fletching member 120 projecting through slot 117, with flanged base 121 disposed within the hollow center portion of fletch holder 122. End cap member 130 may then be threaded onto end 128, via cooperating threaded elements 128*a*, 130*a*, with slot 117 disposed proximate flanged base member 121.

When end cap member 130 is fully affixed to fletch holder 122, it will be observed that the assembly acts to compress and firmly retain each fletching member 120 within each corresponding slot 117. This disposition of elements might be roughly analogized to the action of a collet or chuck upon a workpiece. As end cap member 130 is tightened by screwing action upon fletch holder 122, via cooperating threaded elements 128*a*, 130*a*, each slot 117 is closed, compressed, and tightened, as by pinching action, about each corresponding fletching member 120; thereby, capturing each fletching member 120 firmly within fletch holder 122. Having thus described the means for clamping fletching member 120 into fletch holder 122, it will be apparent to those of ordinary skill in the art that the minimum width of each slot 117 should be established so that, when fully compressed, slot 117 does not cut, shear, or otherwise damage or impair fletching member 120.

Of course, to disassemble and remove a fletching member 120, the process may simply be reversed. Advantageously, this process is simple, precise, and rapid; and well-disposed for field or range replacement of fletching members. Accordingly, if fletching member 120 becomes damaged or worn, or if a user wishes to remove or replace fletching member 120 for any reason, end cap member 130 may be removed from fletch holder 122 by unscrewing it from end 128, either directly or, in appropriate cases, via rotation of nock 135. Fletching member 120 may then preferably be removed from slot 117 by sliding flanged base 121 towards end 128, preferably through open end 117*b*; thereby, enabling extraction of fletching member 120. Alternatively, fletching member 120 may just be pulled radially out of slot 117, whereby flanged base 121 may deform, allowing fletching member 120 to pass through slot 117. Preferably, a new fletching member 120 may then be inserted in slot 117, in the manner described hereinabove, and retained therein using end cap member 130, also as described above.

It will, of course, be appreciated by those of ordinary skill in the art that fletch holder 122 described hereinabove may be provided, in an appropriate case, in unitary, integral, or single piece construction with arrow shaft 110. Similarly, the elements, pieces, and parts of the invention described herein, and methods of affixation and use thereof, may be varied, reconfigured, and rearranged to meet the function, and achieve the benefits of, the present invention. All such modifications are considered to be within the scope, spirit, and subject matter of the present invention.

For example, and with continuing reference to FIG. 7, providing an embodiment of form illustratively configured for use as a cross bolt, relative diameters and lengths of flange means 127, 129, thickness and diameter of fletch holder side wall 118, length of cut of slots 117, type and shape of fletching member 120, surface features of outer surface 131, and the like, without limitation, may be modified as desired by usage, design, assembly, weight, bow interface criteria, and flight considerations, to name a few. The configuration shown in FIG. 7, for example, provides a cross bolt in accordance with the present disclosure that may be fired without interference from the rail of a cross bow.

Having, thus, described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed:

1. A fletching system for use in association with an arrow shaft, the fletching system comprising:

a fletch holder having at least one slot formed radially through a sidewall thereof;

an end cap member adapted for removable association with said fletch holder at an end thereof, said end cap member operable to compress said at least one slot when said end cap member is associated with said fletch holder; and a nock adapted for association with said end cap member at an end thereof.

2. The fletching system of claim 1, wherein said slot is formed generally axially in said fletch holder.

3. The fletching system of claim 1, wherein said slot comprises a closed periphery disposed adjacent to or within flange means at a first end thereof and an opening disposed adjacent to or within flange means at a second end thereof.

4. The fletching system of claim 1, wherein said slot comprises a first portion having a first width adjacent to or proximate a first end of said fletch holder and a second portion having a second width adjacent to or proximate a second end of said fletch holder.

5. The fletching system of claim 4, wherein said second portion is disposed adjacent said first portion and proximate an end of said slot.

6. The fletching system of claim 1, further comprising a fletching member.

7. The fletching system of claim 6, wherein said fletching member comprises a generally planar body and a base portion.

8. The fletching system of claim 7, wherein said base portion has a width that is greater than a width of at least a portion of said slot.

9. The fletching system of claim 6, wherein said fletching member is disposed at least partially within said slot and extends therethrough.

10. The fletching system of claim 9, wherein said fletching member is removably retained within said slot by said base portion.

11. The fletching system of claim 1, wherein said end cap member is disposed proximate said slot.

12. The fletching system of claim 1, wherein said fletch holder is affixed to an end of an arrow shaft.

13. The fletching system of claim 12 wherein said fletch holder is affixed to an end of an arrow shaft via one of either a press fit or cooperating threaded means.

14. The fletching system of claim 1, wherein said end cap member is attached at a first end via threads to an end of said fletch holder and at a second end to a press-fit nock.

15. The fletching system of claim 1 wherein said slot is formed in one of a spiral configuration or a helical configuration.

16. A fletching system for an arrow comprising:

(a.) a fletch holder having a recessed or hollow portion, and at least one slot running longitudinally therealong with respect to a long axis of the fletch holder;

(b.) the slot being open at a second end of the fletch holder; and (c.) the fletch holder cooperatively affixed at the second end thereof to a first end of an end cap member, said end cap member operable to compress said at least one slot when said end cap member is affixed to said fletch holder;

(d.) the end cap member cooperatively affixed at the second end thereof to a nock;

whereby a fletching member may be captured and retained in a position projecting through the slot of the fletch holder by affixation of the end cap member to the fletch holder.

17. A method of attaching a fletching member to a fletch holder comprising the steps of:

(a.) sliding a base portion of said fletching member through a slot formed through a sidewall of said fletch holder; and (b.) affixing a first end of an end cap member to said fletch holder, said first end of said end cap member operable to compress said slot when said end cap member is affixed to said fletch holder, said end cap member cooperatively affixed at a second end thereof to a nock, such that said slot is disposed in frictional fit engagement with said base portion, thereby securely attaching said fletching member to said fletch holder.

18. The method of claim 17, further comprising the step of rotating said end cap member to increase a force component of said frictional fit engagement.

19. The method of claim 17, further comprising the step of removing the end cap member from said fletch holder by unscrewing the end cap member from an end of said fletch holder.

20. The method of claim 17, wherein the sliding step further includes sliding the base portion from an outside of said fletch holder through said slot to an interior of said fletch holder.

* * * * *